US007785211B2

(12) United States Patent
Hackenberg

(10) Patent No.: US 7,785,211 B2
(45) Date of Patent: Aug. 31, 2010

(54) GOLF SWING TRAINER HAVING BALANCED CENTER OF MASS

(76) Inventor: James A. Hackenberg, P.O. Box 205, Edgartown, MA (US) 02539

( * ) Notice: Subject to any disclaimer, the term of this patent is extended or adjusted under 35 U.S.C. 154(b) by 0 days.

(21) Appl. No.: 11/904,214

(22) Filed: Sep. 26, 2007

(65) Prior Publication Data

US 2009/0082124 A1 Mar. 26, 2009

(51) Int. Cl.
*A63B 69/36* (2006.01)
*A63B 53/10* (2006.01)

(52) U.S. Cl. ..... 473/256; 473/224; 473/297; 473/409

(58) Field of Classification Search ..... 473/201, 473/203, 206, 219, 226, 231, 232, 233, 234, 473/456, 457, 292, 297, 298, 299, 318, 519–521, 473/523, 409
See application file for complete search history.

(56) References Cited

U.S. PATENT DOCUMENTS 1,662,712 A * 3/1928 Mensing ..... 473/318
2,388,463 A * 11/1945 Benecke ..... 473/234
2,396,408 A * 3/1946 Benecke ..... 473/234
2,928,678 A * 3/1960 Cutting ..... 473/206
2,992,828 A * 7/1961 Stewart ..... 473/314
3,070,370 A * 12/1962 Steiner ..... 473/295
3,428,325 A * 2/1969 Atkinson ..... 473/256
3,743,297 A * 7/1973 Dennis ..... 473/242
3,921,976 A 11/1975 Lane
4,042,237 A 8/1977 Moraru
4,846,472 A 7/1989 Terza
5,011,145 A 4/1991 Bartkowicz
5,026,064 A * 6/1991 Novosel ..... 473/235
D328,935 S * 8/1992 Dixon, Jr. ..... D21/722
5,230,506 A 7/1993 Cipriano et al.
5,244,209 A * 9/1993 Benzel ..... 473/297
5,259,617 A * 11/1993 Soong ..... 473/305
5,316,306 A * 5/1994 Cody ..... 473/239
5,364,102 A * 11/1994 Appledorn ..... 473/297
5,465,967 A * 11/1995 Boeckenhaupt ..... 473/297
5,492,321 A 2/1996 Cipriano
5,505,454 A * 4/1996 Gagarin ..... 473/232
5,531,438 A 7/1996 Corley
5,577,966 A * 11/1996 Duran ..... 473/234
5,618,039 A 4/1997 Tsai et al.
5,626,527 A * 5/1997 Eberlein ..... 473/203
5,716,289 A * 2/1998 Okoneski ..... 473/297

(Continued)

OTHER PUBLICATIONS

PracticeRange.com Golf Tarining Aids & Advice, Medicus Hinged 5-Iron, http://www.practicerange.com/detail.aspx?ID=3, Jan. 12, 2007, pp. 1-3.

(Continued)

*Primary Examiner*—Nini Legesse
(74) *Attorney, Agent, or Firm*—Craig R. Miles; CR Miles, P.C.

(57) ABSTRACT

A golf swing trainer providing a resiliently flexible shaft having a first shaft end coupled to a swing element and a second shaft end coupled to a grip having a tapered external surface gripably received by the hands.

16 Claims, 6 Drawing Sheets

U.S. PATENT DOCUMENTS

Figure 1:
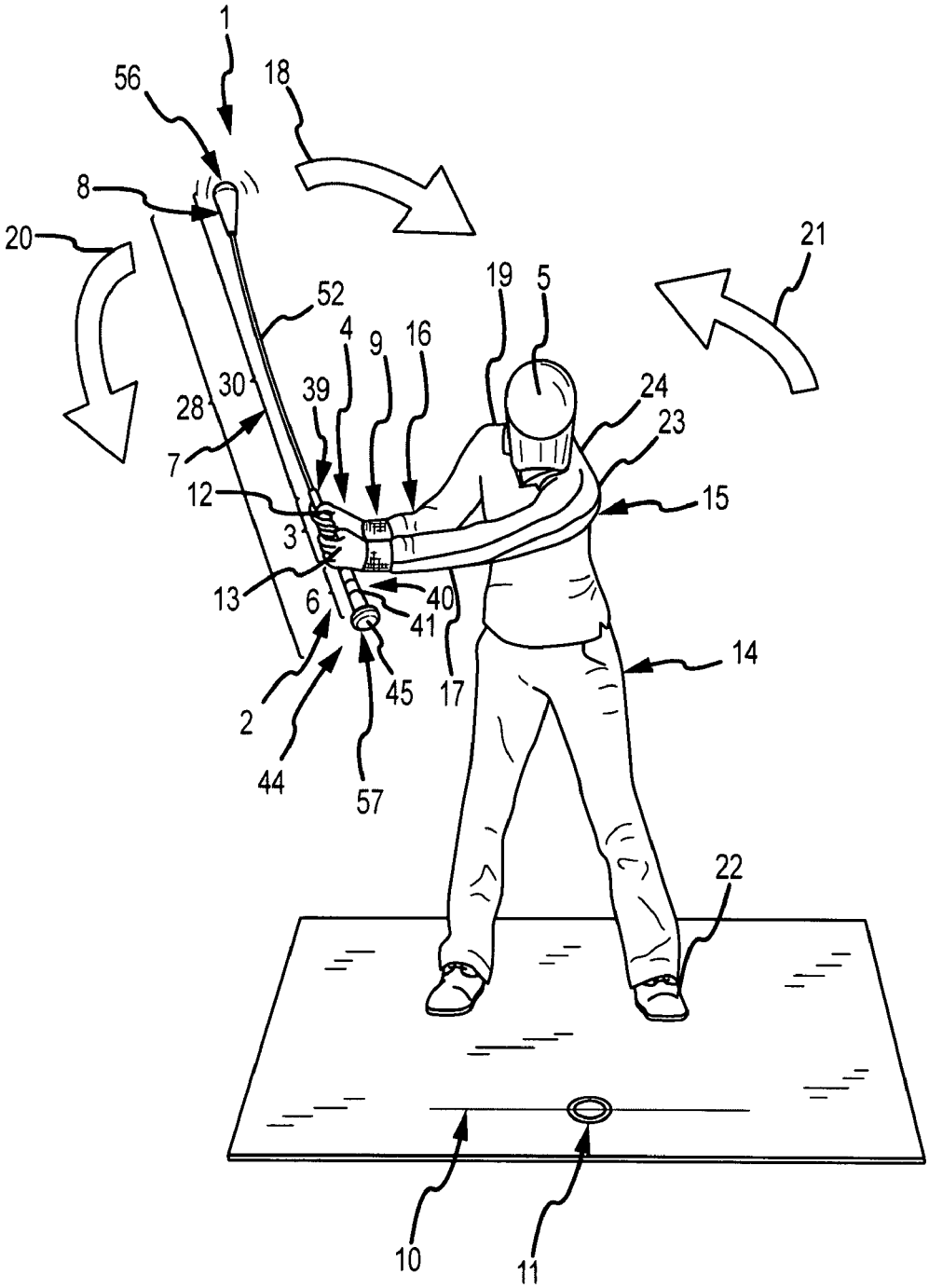

| | | | | |
|---|---|---|---|---|
| 5,755,631 | A | 5/1998 | Paschka | |
| 5,807,183 | A * | 9/1998 | Benson | 473/206 |
| D413,641 | S | 9/1999 | Falco | |
| 6,241,623 | B1 * | 6/2001 | Laibangyang | 473/232 |
| 6,458,037 | B1 | 10/2002 | Dixon, Jr. | |
| 6,786,841 | B1 | 9/2004 | Dixon | |
| 6,966,844 | B2 * | 11/2005 | Welles | 473/224 |
| 2003/0148819 | A1 * | 8/2003 | Lindner | 473/316 |

OTHER PUBLICATIONS

PracticeRange.com Golf Tarining Aids & Advice, Swing Eez, http://www. practicerange.com/detail.aspx?ID=696, Dec. 23, 2006, pp. 1.

PracticeRange.com Golf Tarining Aids & Advice, Whippy TempoMaster Driver, http://www.practicerange.com/detail.aspx?ID=712, Dec. 26, 2006, pp. 1-3.

* cited by examiner

GOLF SWING TRAINER HAVING BALANCED CENTER OF MASS

BACKGROUND

A golf swing trainer providing a resiliently flexible shaft having a first shaft end coupled to a swing element and a second shaft end coupled to a grip having a tapered external surface gripably received by the hands.

Great golf results from a great golf swing. Accordingly, there are many golf swing training devices which can be utilized by a trainee to improve the golf swing. Certain conventional golf swing training devices provide a golf club having a resiliently flexible shaft. A conventional golf club head having an asymmetric configuration about the longitudinal axis of the golf club shaft may be coupled to a first shaft end. A significant problem with this type of golf swing training device may be that the asymmetry of a conventional golf club head can generate vector forces which alter as the flexible shaft flexes or returns toward the unflexed condition during the backswing or the downswing which must be compensated by the trainee. Compensation of these forces can make achieving swing rhythm and swing balance more difficult.

Other conventional golf swing training devices include a hinged shaft which operates to collapse the golf swing training device when the swing of the trainee does not correspond to the swing mechanics which maintain the uncollapsed condition. A significant problem with this type golf swing training device may be that it can be difficult to recognize incremental improvement in swing mechanics when the golf swing training device collapses even while trainee swing mechanics are improving.

Other conventional golf swing training devices include a conventional golf club handle coupled to substantially non-resilient flexible tube at a first end and a spherical swung element coupled to the second end. A substantial problem with this type of golf swing training device may be too little resilience in the flexible tube which correspondingly generates too great a lag in the swung element in response to the downswing of the trainee or may be too little mass in the swung element to correctly condition the golf swing of the trainee.

Another substantial problem with conventional golf swing training devices can be the lack of any golf swing training device elements which assist in conditioning of wrist action to hinge and unhinge the wrists properly during backswing and downswing and to prevent breaking. A great golf swing results from proper wrist action resulting from a good grip. A trainee's wrists can move in two directions during a golf swing. A forward and backward motion in the direction of the swing known as "breaking" and an upward and downward motion known as "hinging". The goal of golf swing training is to eliminate breaking and to naturally create the proper hinging action as a result of proper grip. However, conventional golf swing training devices rely upon conventional golf club handles which do not additionally assist the trainee in recognizing the proper grip and proper hinging.

By providing a golf swing trainer having structural elements not prior included in conventional golf swing training devices, the inventive golf swing trainer described herein addresses the problems above described.

SUMMARY OF THE INVENTION

Accordingly, a broad object of the invention can be to provide a golf swing trainer which has a resiliently flexible shaft providing a first shaft end coupled to a swing element and a second shaft end coupled to a grip which provides a first grip part gripably received by the hands of a person and a second grip part which extends a distance beyond first grip part as a counter balance to the resiliently flexible shaft coupled to the swing element to isolate the hinging and unhinging of the wrists.

Another broad object of the invention can be to provide a golf swing trainer which has a resiliently flexible shaft providing a first shaft end coupled to a swing element and a second shaft end coupled to a grip providing a tapered external surface having a lesser diameter end coupled to the second shaft end and a greater diameter end distal from the second shaft end to assist in developing the correct grip.

Another broad object of the invention can be to provide a golf swing trainer which has a resiliently flexible shaft providing a first shaft end coupled to a swing element symmetrical about the longitudinal axis of the resiliently flexible shaft in the unflexed condition and a second shaft end coupled to a grip providing a tapered external surface having a lesser diameter end coupled to the second shaft end and a greater diameter end distal from the second shaft end to assist in developing golf swing balance and golf swing rhythm.

Naturally, further objects of the invention are disclosed throughout other areas of the specification, drawings, photographs, and claims.

A BRIEF DESCRIPTION OF THE DRAWINGS

FIG. 1 shows a particular method of using the inventive golf swing trainer.

Figure 2:
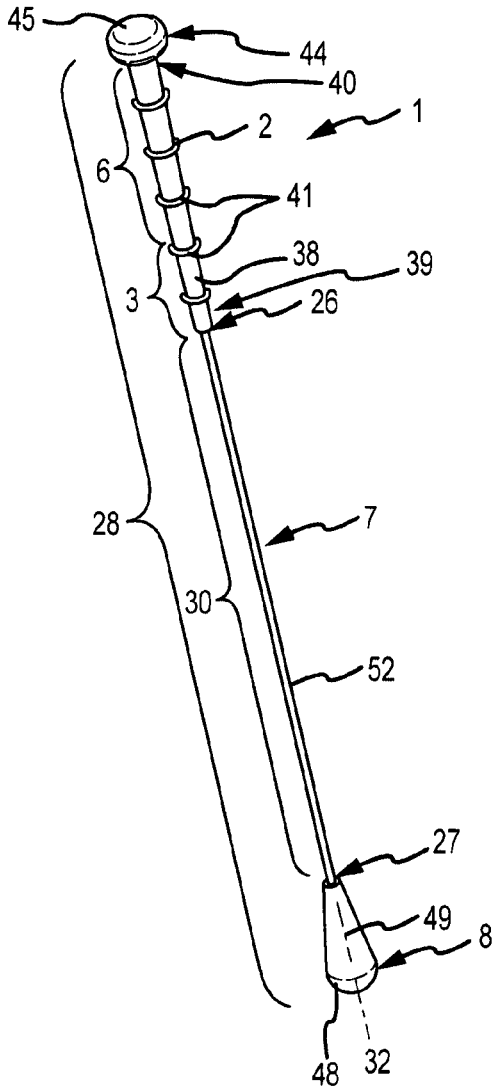

FIG. 2 provides a perspective view of a particular embodiment of the inventive golf swing trainer.

Figure 3:
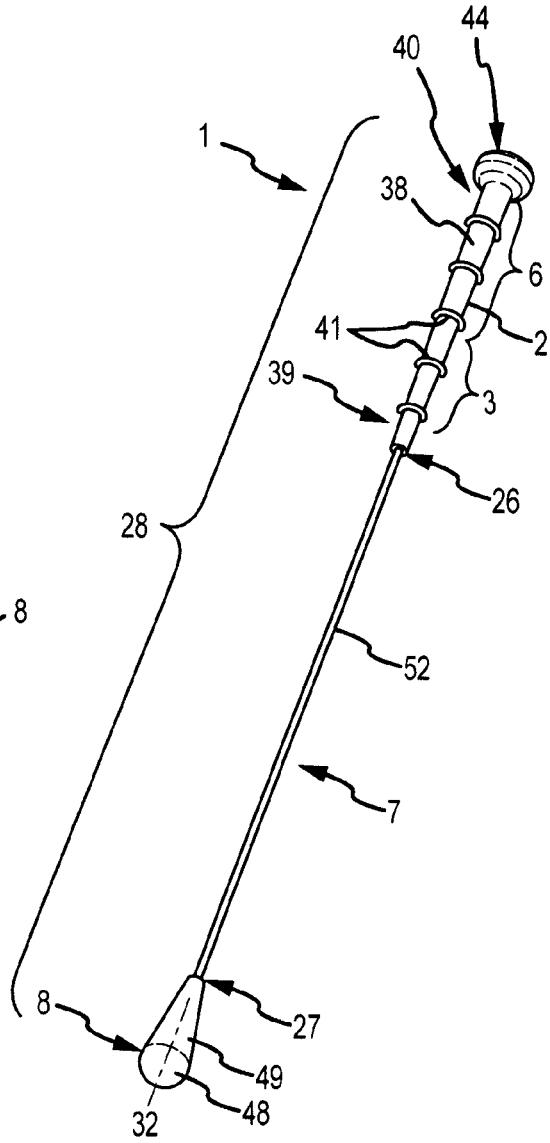

FIG. 3 provides a perspective view of a particular embodiment of the inventive golf swing trainer.

Figure 4:
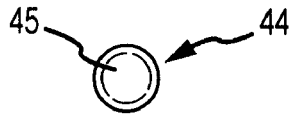

FIG. 4 provides an end view of a particular embodiment of the inventive golf swing trainer.

Figure 5:
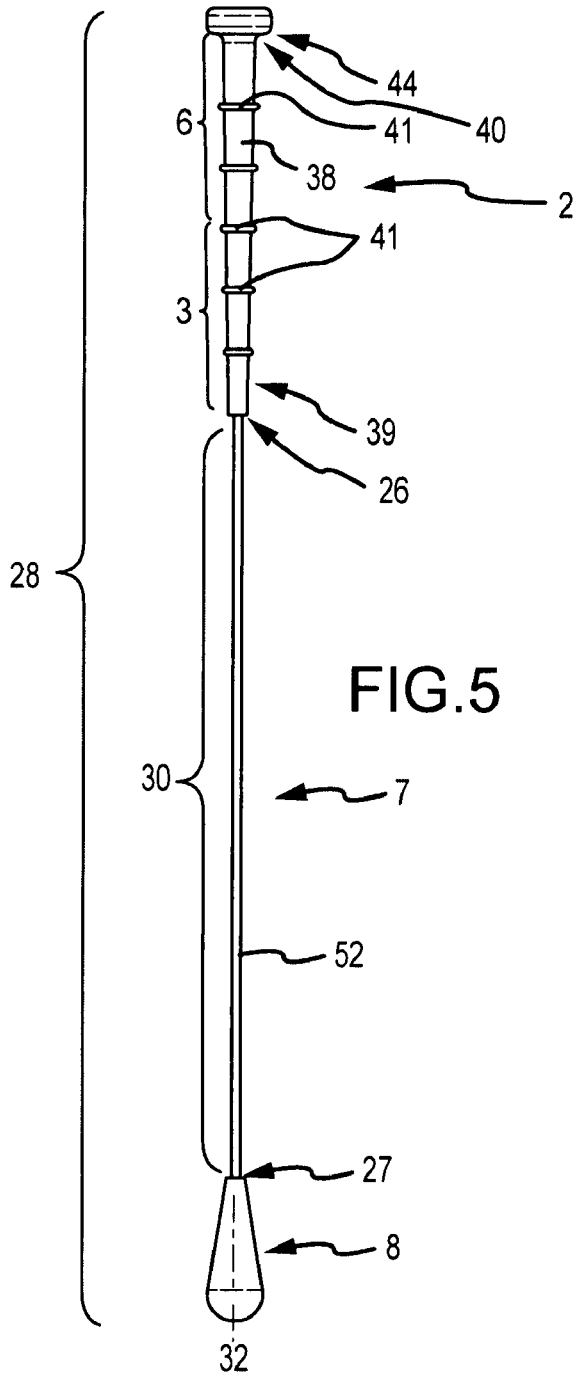

FIG. 5 provides a side view of a particular embodiment of the inventive golf swing trainer.

Figure 6:
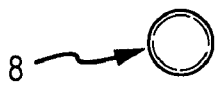

FIG. 6 provides an end view of a particular embodiment of the inventive golf swing trainer.

Figure 7:
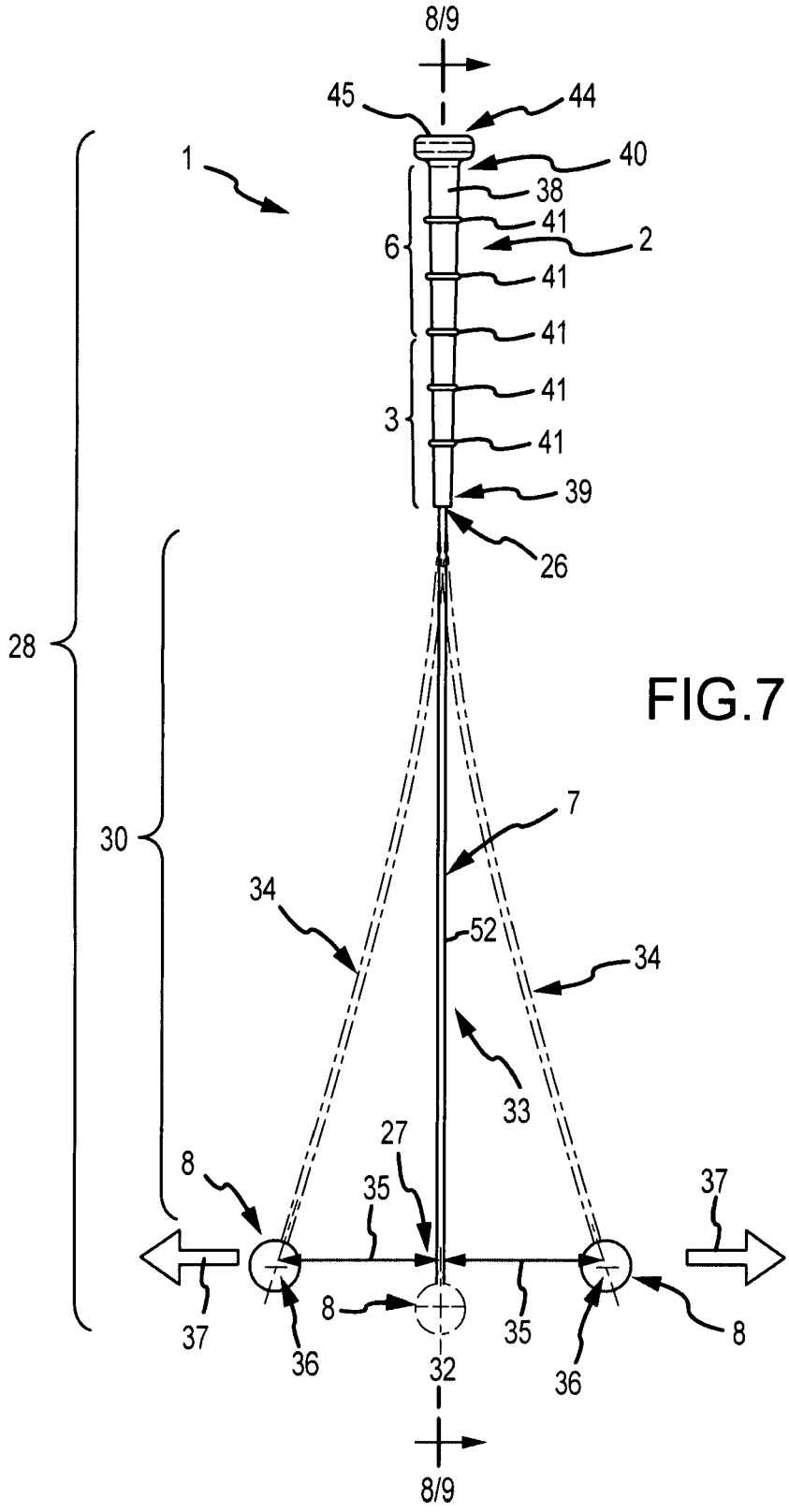

FIG. 7 provides a side view of a particular embodiment of the inventive golf swing trainer in an unflexed condition (unbroken lines) and further showing the inventive golf swing trainer particular flexed conditions (broken lines).

Figure 8:
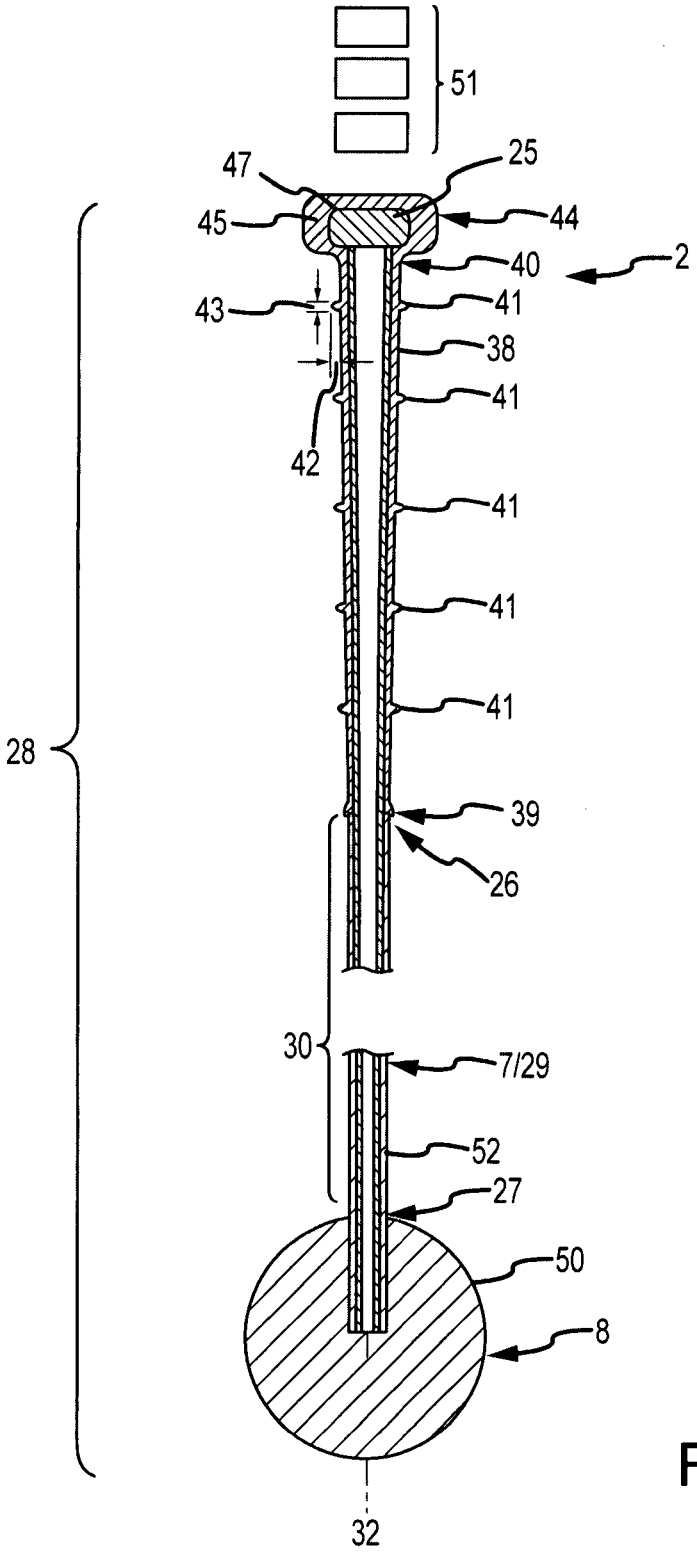

FIG. 8 provides a cross section 8-8 of a particular embodiment of the inventive golf swing trainer shown in FIG. 7.

Figure 9:
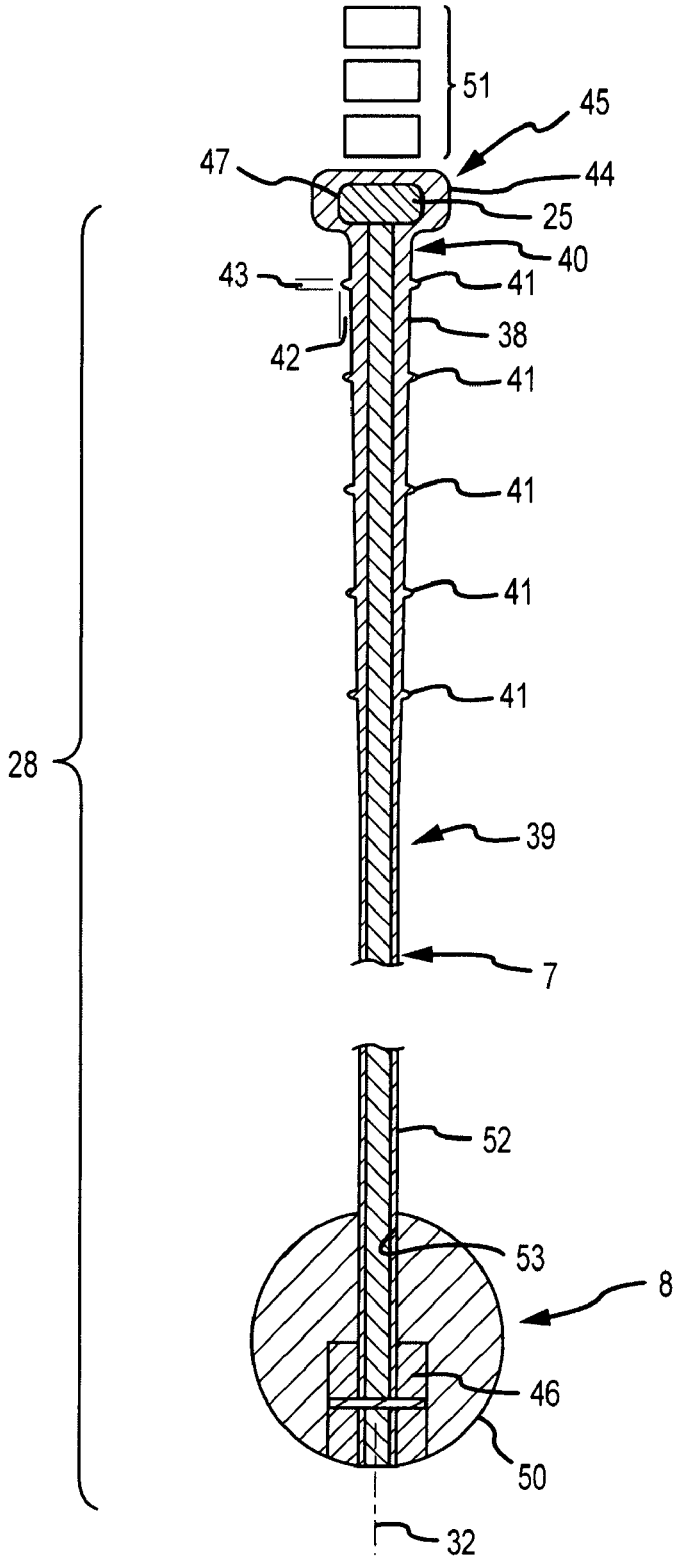

FIG. 9 provides a cross section 9-9 of another particular embodiment of the inventive golf swing trainer shown in FIG. 7.

DETAILED DESCRIPTION OF THE PREFERRED EMBODIMENTS

A golf swing trainer which provides a resiliently flexible shaft providing a first shaft end coupled to a swing element and a second shaft end coupled to a grip which provides a first grip part gripably received by the hands of a trainee and a second grip part which extends a distance beyond the first grip part as a counter balance to the resiliently flexible shaft coupled to the swing element.

Now referring primarily to FIG. 1, a particular method of golf swing training includes providing a golf swing trainer (1) having a grip (2) which provides a first grip part (3) gripably received by the hands (4) of a trainee (5) and a second grip part (6) which extends a distance beyond the hands (4) to counter balance (whether in whole or in part) the mass of the flexible shaft (7) coupled to the swing element (8) to promote proper hinging and unhinging of the wrists (9) of the trainee (5).

The trainee (5) can by squarely facing the target line (10) (the imaginary line along which the swing element (8) travels in relation to the training mark (11)) can establish a grip about the first grip part (3) of the grip (2). The first grip part (3) of the golf swing trainer (1) can be gripably received with both hands (4) with the right hand (12) below the left hand (13)(for right-handed trainees), the swing element (8) resting on the ground behind the training mark (11). By shifting body weight of the trainee (5) to the right side and contemporaneously turning the pelvis (14) and shoulders (15) and lifting of the arms (16) while flexing of the elbows (17) and wrists (9) the backswing (18) can be accomplished. At the end of the backswing (18) the hands (4) are above the right shoulder (19), with the golf swing trainer (1) pointing more or less in the intended direction of ball flight. The downswing (20) is roughly a backswing reversed. Swinging the swing element (8) over the training mark (11) continued rotating of the swing element (8) to the left generates the follow-through (21). At the end of the follow through (21), the body weight of the trainee (5) has shifted almost entirely to the left foot (22), the body of the trainee (5) is fully turned to the left and the hands (4) are above the left shoulder (23) with the golf swing trainer (1) hanging down over the back (24) of the trainee (5).

Now referring primarily to FIGS. 1, 8 and 9, by adjusting the mass of the second grip part (6)(also including the mass of the grip end (44) as further described below) to counter balance a greater or lesser amount of the mass of the flexible shaft (7) and the swing element (8) (by either adding weight to or removing weight from the second grip part (6) or by further providing a counter balance element (25) as shown for example in FIG. 8) or by altering location at which the first grip part (3) is gripingly receiving by the hands (4) of the trainee (5), the second grip part (6) can to a greater or lesser level assist in the hinging and unhinging of the wrists (4) of the trainee (5) and eliminate breaking of the wrists (4) during a swing training drill. A swing training drill can include serial repetition of the steps above described without pause between repetitions.

Now referring primarily to FIGS. 2-6, a certain embodiment of the golf swing trainer (1) is shown which can provide a resiliently flexible shaft (7) having second shaft end (26) coupled to a grip (2) and a first shaft end (27) coupled to a swing element (8). The resiliently flexible shaft (7) can be adjusted in length depending upon the configuration and coupling of the grip (2) and the configuration and coupling of the swing element (8) to provide a golf swing trainer (I) having a total length (28)(see FIG. 2) between golf swing trainer ends (56)(57) of between about 48 inches and about 50 inches. As to certain embodiments of the inventive golf swing trainer (1), the resiliently flexible shaft (7) can have a substantially continuous diameter between the first shaft end (27) and the second shaft end (26) (as shown for example in FIGS. 2-7) of between about one-eighth inch and about three eighths inch with a preferred embodiment having a diameter of about one-quarter inch. Other particular embodiments of the inventive golf swing trainer (1) can provide a tapered flexible shaft (29)(as shown for example by FIGS. 8 and 9) which as to the second shaft end (26) coupled to the grip (2) can be between about one half inch in diameter and about three quarters inch in diameter and as to the second shaft end (27) coupled to the swing element (8) can be between about one quarter inch in diameter to about three eighths inch in diameter. Certain embodiments of the resiliently flexible shaft (7) can have a hollow passage (54) as shown in FIG. 8 while other embodiments of the resiliently flexible shaft (7) can be a solid rod (55) as shown in FIG. 9. The flexible shaft (7)(29) can be configured from a variety of materials which provide resilient flexure as further described below. As a non-limiting example, a preferred embodiment of the golf swing trainer (1) can be produced from E-glass reinforcements with a thermoset vinyl ester resin matrix ("E-glass rod"). A variety of configurations of E-glass rod suitable for use in the invention can be obtained from various commercial sources such as Glasforms, Inc. of San Diego Calif.

Now referring primarily to FIG. 7, the resiliently flexible shaft (7) can provide a resiliently flexible part (30) with a length of between about 28 inches and about 30 inches (not including any additional length of the resiliently flexible shaft (7) surrounded by or engaged by the grip (2) or the swing element (8)). The resiliently flexible part (30) of the flexible shaft (7) can be configured to provide a particular amount of resilient flexure (34)(shown in broken lines) from the longitudinal axis (32) of the flexible shaft (7) in the unflexed condition (33)(shown in unbroken lines) which allows the swing element (8) a travel distance (35) from the longitudinal axis (32) of the resiliently flexible shaft (7) of between about 7 inches and about 12 inches. The travel distance (35) can be measured as the least distance between about the center of the of the swing element (36) in the flexed condition (34) of the resiliently flexible shaft (7) under a load (37) of between about 225 grams (g) and about 300 g such load including the weight of the swing element (8) and the longitudinal axis (32) of the resiliently flexible shaft (7)(29) in the unflexed condition (33)(see FIG. 7 with travel distance (35) indicated by arrow). As a first non-limiting example, the resiliently flexible shaft (7) can have a resiliently flexible part (30) of forty eight inches which affords a travel distance of about eight and one-half inches under a load of 225 grams. As a second non-limiting example, the resiliently flexible shaft (7) can have a resiliently flexible part (30) of forty eight inches which affords a travel distance of about eleven inches under a load of 300 grams.

Again referring primarily to FIGS. 2-6, the grip (2) coupled to the second shaft end (26) of the resiliently flexible shaft (7) can provide a tapered external surface (38) disposed between the lesser diameter grip end (39) and the greater diameter grip end (40). The lesser diameter grip end (39) can be disposed proximate to the resiliently flexible part (30) of the resiliently flexible shaft (7) and the greater diameter grip end (40) can be disposed distal from the resiliently flexible part (30) of the resiliently flexible shaft (7) with a distance between the lesser diameter grip end (39) and the greater diameter grip end (40) of between about thirteen inches and about fifteen inches (a preferred embodiment being about fourteen inches. As to certain embodiments of the inventive golf swing trainer (1), the lesser diameter grip end (39) of the grip (2) can be between about three eighths inch and about three quarters inch, with a preferred embodiment having a diameter of about three quarters inch. The greater diameter grip end (40) can be between about one-half and one inch with a preferred embodiment having a diameter of about one inch. As to preferred embodiments of the invention, the difference in diameter of the lesser diameter grip end (39) and the greater diameter grip end (40) can be about one quarter inch.

The tapered external surface (38) of the grip (2) can provide a first grip part (3) which gripably receives the hands (4) of the trainee (5) proximate to the lesser diameter grip end (39) and a second grip part (6) which extends beyond the first grip part (3) a distance toward the trainee (5) from the location on the first grip part (3) which gripably receives the hands (4) of between about 5 inches and about 10 inches but typically providing a second grip part (6) of not less than about five inches.

The grip (2) can further include a plurality of grip rings (41) each of which circumferentially couple to the tapered external surface (38) of the grip (2) with the plurality of grip rings (41) spaced a distance apart between the lesser diameter grip end (39) and the greater diameter grip end (40). While FIGS. 1-9 show each one of the plurality of grip rings (41) projecting outwardly from the tapered external surface (38) of the grip (2). The plurality of grip rings (41) can also be configured as a plurality of circumferential grooves or a combination of projections and grooves (with certain embodiments being circumferentially discontinuous or broken circumferential rings or grooves) which act as indicia both tactile and visual to allow the trainee (5) to repeatedly gripably receive the first grip part (3) at about the same location from swing to swing of the golf swing trainer (1). As to certain embodiments of the plurality of grip rings (41), the first of the plurality of grip rings (41) can have a location about three inches from the lesser diameter grip end (39) with each additional one of the plurality of grip rings (41) spaced a distance of about two inches between each pair of the plurality of grip rings (41). Based on this spacing, a total of five can make up the plurality of grip rings (41). Each of the plurality of rings (41) can project outwardly from the tapered external surface (38) of the grip (2) to provide a ring projection height (42) of about one thirty second of an inch and have a ring width (43)(see FIG. 8) of about one thirty second of an inch and be spaced a distance of about two inches apart. While this non-limiting example of a preferred embodiment of the invention is shown in the Figures, it not intended that this particular example be limiting to with respect to the numerous and varied constructional forms of the grip (2) certain of which may include a greater or fewer plurality of grip rings (41) or have a different spacing, ring projection height, ring groove depth, or the like.

Now referring primarily to FIGS. 2-8, the grip (2) can further include a grip end (44) coupled to the greater diameter grip end (40). The grip end (44) can be configured to provide a grip end external surface (45) which extends radially outward from the tapered external surface (38) of the grip (2). As but one non-limiting embodiment, the grip end (44) can be configured as a cylinder having a height of between about one half inch to about one inch with a diameter of between about one and one half inch to about two inches (as shown the edges of the cylindrical configuration shown by FIGS. 2-8 can have an amount of radius and cylindrical embodiments of the grip end (44) may only be substantially cylindrical in configuration). However, certain embodiments of the grip end (44) can provide a hemispherical or spherical constructional form (for example a sphere having about a one inch radius). The grip end (44) can, as to certain embodiments of the inventive golf swing trainer (1), be part of a one piece integral grip (2) and grip end (44) which couples about the second shaft end (26) of the resiliently flexible shaft (7) (as shown for example in FIG. 8). The integral one piece grip (2) and grip end (44) can be fixed to the resiliently flexible shaft (7) by frictional engagement, friction welding, adhesive, mated spiral threads, mechanical fasteners, molding the grip about the resiliently flexible shaft (7), or the like, to provide a grip (2) having the tapered external surface (38) of the grip (2). Alternately, the grip (2) and the grip end (44) can be separate pieces which can be mated or joined by mechanical hardware such as mated spiral threads, post and socket, or the like. The joined pieces of the grip (2) and grip end (44) can be fixed to the resiliently flexible shaft (7) as above described or otherwise.

Now referring primarily to FIGS. 8 and 9, the grip end (44) can further include a counter balance element (25) which as to particular embodiments of the golf swing trainer (1) can be provided as an integral one piece grip end (44) and counter balance element (25). An integral one piece grip end (44) and counter balance element (25) can be achieved by configuring the grip end (44) from a material having a density which provides sufficient mass in the configuration of the grip end (44) coupled to the grip (2). Other particular embodiments of the golf swing trainer (1), can provide the grip end (44) formed about the counter balance element (25)(as shown in FIGS. 8 and 9) or providing a hollow space (47) in which the counter balance element (25) can be inserted or located prior to coupling the grip end (44) to the grip (2). As to other certain embodiments of the invention, the grip end (44) and the counter balance element (25) can be configured to separate or disengage to allow one or more of a plurality of counter balance elements (51) to be interchangeably located in the hollow space (47) or otherwise interchangeably coupled to the grip end (44) to adjust mass of the grip end (2). These examples of a counter balance element are not intended to be limiting and the counter balance element (25) can take any constructional form which contributes a greater mass to the second grip part (6) as a counter balance to the resiliently flexible shaft (7), the swing element (8) and the first grip part (3). The grip (2) including the first grip part (3), the second grip part (6), the grip end (44) and the grip end counter balance element (25) can weigh between about 175 grams to about 275 grams with preferred embodiments weighing between about 200 grams to 250 grams.

Again referring to FIGS. 2-8, the inventive golf swing trainer (1) can further include a swing element (8) coupled to the first shaft end (27) of the resiliently flexible shaft (7). The swing element (8) can be coupled to the first shaft end (27) by frictional engagement, friction welding, mated spiral threads, post and socket engagement fixed by mechanical fasteners, molded engagement about the resiliently flexible shaft, or the like. The various embodiments of the swing element (8) have substantially radial symmetry about the longitudinal axis (32) of the first shaft end (27). Particular embodiments of the swing element (8) as shown in FIGS. 2-7 may provide and external surface configured substantially as a hemisphere (48) having a radius of between about one and one half inches to about two inches which has conical taper element (49) which joins the first shaft end (27). Other embodiments of the swing element (8) as shown by FIG. 8 may provide a substantially spherical external surface (50) configuration having a radius of between about one and one half inches to about two inches. The swing element (8) can have a weight of about 225 grams to about 325 grams. A preferred embodiment of the invention having a swing element (8) providing a spherical external surface (50) which defines a radius of about two inches with a weight of about 275 grams.

Certain embodiments of the swing element (8) can be produced as a polymer foam generated utilizing a reaction mixture including an isocyanate (which without limitation can be in the form of an isothiocyante or MDI prepolymer), a polyol (which can further include a diluent), a chain extender, a catalyst, and a blowing agent which can be introduced into a mold into which a portion of the second shaft end (27) has been inserted.

While particular embodiments of the swing element (8) may incorporate an amount of methylene diphenyl diisocyanate as a MDI prepolymer in the range of about 5 percent (%) to about 20% (herein % refers to parts per hundred parts of the reaction mixture by weight) or an amount of 4,4' methylene diphenyl diisocyanate as a MDI prepolymer in the range of about 5% to about 20% (or both in various combinations in the range of 5% to about 20%) into the reaction mixture, a numerous and wide variety of isocyanates (or isothiocyantes) or mixtures thereof can be utilized such as: 1,6-hexamethylene diisocyanate, 1,4-butylene diisocyanate, furfurylidene diisocyanate, 2,4-toluene diisocyanate, 2,6-toluene diisocyanate, 2,4'-diphenylmethane diisocyanate, 4,4'-diphenylmethane diisocyanate, 4,4'-diphenylpropane diisocyanate, 4,4'-diphenyl-3,3'-dimethyl methane diisocyanate, 1,5-naphthalene diisocyanate, 1-methyl-2,4-diisocyanate-5-chlorobenzene, 2,4-diisocyanato-s-triazine, 1-methyl-2,4-diisocyanato cyclohexane, p-phenylene diisocyanate, m-phenylene diisocyanate, 1,4-naphthalene diisocyanate, dianisidine diisocyanate, bitolylene diisocyanate, 1,4-xylylene diisocyanate, 1,3-xylylene diisocyanate, bis-(4-isocyanatophenyl)methane, bis(3-methyl-4-isocyanatophenyl) methane, polymethylene polyphenyl polyisocyanates, or the like.

The swing element (8), can further incorporate an amount of hydroyxl-terminated polyether polyol having a molecular weight of at least 1,500 in the range of about 75% to about 95% (which may have the viscosity diluted with an amount of propylene carbonate in the range of about 1% to about 5%) into the reaction mixture; however, this is not intended to be limiting with respect to the numerous and wide varieties of polyols that can be included in the reaction mixture which in the alternative can include a hydroxyl-terminated backbone of a member selected from the group comprising a polyether, a polyester, a polycarbonate, a polydiene and a polycaprolactone, a hydroyl-terminated polyhydrocarbon, a hydroxyl-terminated polyformal, a fatty acid triglycerides, a hydroxyl-terminated polyesters, a hydroxymethyl-terminated polyesters, a hydroxymethyl-terminated perfluoromethylenes, a polyalkyleneether glycols, a polyalkylenearyleneether glycols, a polyalkyleneether triols, a adipic acid-ethylene glycol polyester, a poly(butylene glycol), a poly (propylene glycol) and a hydroxyl-terminated polybutadiene, separately or in various combinations or permutations.

The swing element (8) can further incorporate an amount of ethylene glycol in a range of about 2% to about 12%, or incorporate an amount of ethylene glycol in a range of about 1% to about 5% and an amount of 1,4-butanediol in a range of about 5% to about 10% as a chain extender in the reaction mixture.

The swing element (8), can further incorporate an amount of gel DABCO 33 LV in the range of about 0.1% to about 3% as a catalyst in the reaction mixture; however, this is not intended to be limiting with respect to the numerous and wide varieties of catalysts that can be included in the reaction mixture and can in the alternative include a DABCO BLV catalyst, a DABCO BL-11 catalyst, a DABCO 2021 catalyst, or the like, separately or in various combinations or permutations.

Similarly, while the swing element (8), can further incorporate a hydrofluorocarbon as a blowing agent (also referred to as foaming agents) such as HFC-245fa in the reaction mixture in the range of about 2% to about 12%; this is not intended to be limiting with respect to the numerous and wide varieties of blowing agents which can be included in the reaction mixture such as HFC-134a, HFC-365mfc, HFC141b, cyclopentane, or the like.

Importantly, the amounts of isothiocyanate, the polyol (along with any diluent), the chain extender, the catalyst, and the blowing agent included in the reaction mixture can be adjusted to generate a cured polymer foam swing element (8) configured as above-described having the proper dimensional proportion and mass.

Typically embodiments of the swing element (8) can have a range of Durometer hardness of between about 55 A to about 50 D; although greater or lesser hardness may be utilized. As to the particular embodiment of the swing element (8) shown in FIGS. 2-7 and 8, as above-described, the swing element can have Durometer hardness of about 60 A.

Additionally, embodiments of the swing element (8) depending on configuration and mass can provide a polymer foam from a properly adjusted reaction mixture having a density of between about 0.5 grams per cubic centimeter (for example a spherical swing element (8) having a radius of about 2 inches and a mass of about 225 grams) and about 5.0 grams per cubic centimeter (for example a spherical swing element (8) having a radius of about one and one half inches and a mass of 325 grams).

Now referring primarily to FIG. 9, a particular embodiment of the inventive swing trainer can provide a swing element (8) having a diameter of about 2.5 inches (about 6.24 centimeters) with a mass of about 125 grams to about 175 grams having a density of about 1 gram per centimeter to about 1.4 grams per centimeter. The swing element (8) of this particular embodiment of the golf swing trainer (1) can further provide a swing element mass (46) coupled to the first end (27) of the resiliently flexible shaft (7). The swing element mass (46) increases mass of the swing element (8) to within the ranges above described of about 225 grams to about 325 grams. As a non-limiting example, the swing element mass (46) can be configured to couple to the first shaft end (27) by socket and post engagement as shown in FIG. 9. The socket and post engagement can be fixed by use of mechanical hardware such as a pin inserted into a bore which traverses the swing element mass (46) and the first shaft end (27) perpendicular to the longitudinal axis (32) of the resiliently flexible shaft (7) in the unflexed condition.

The swing element mass (46) joined to the first shaft end (27) of the resiliently flexible shaft (7) can provide a constructional form which the swing element (8) can be molded, formed, or located about to cover the swing element mass (46). The particular constructional form of the swing element mass (46) joined to the first shaft end (27) of the resiliently flexible shaft (7) shown by FIG. 9 allows the swing element (8) to further provide a swing element passage (53) through which the second shaft end (26) passes to allow the swing element (8) to slidingly travel along the resiliently flexible shaft (7) to a fixed location which covers a part of the first shaft end (27) and the swing element mass (46). Understandably, the swing element mass (46) joined to the first shaft end (27) (whether joined as shown, by mated spiral threads, friction welded, adhesive, or formed as a single integral piece) can take a numerous and wide variety of constructional forms to which the swing element passage (53) can be correspondingly configured to allow slidingly mated engagement of the swing element (8) about the swing element mass (46) joined to the first shaft end (27).

Now referring to FIGS. 8 and 9, the golf swing trainer (1) can further include a flexible sleeve (52) about which a portion of the grip (2) couples and about which a portion of the swing element (8) couples. The flexible sleeve (52) can act to protect the resiliently flexible shaft (5) from damage upon impact and can protect the trainee (5) from fibers that may separate from the resiliently flexible shaft (7). As to the embodiment of the golf swing trainer (1) shown in FIGS. 2-7, the resiliently flexible shaft (7) can have a diameter of about one-quarter inch and the flexible sleeve (52) (which can be produced as a polyvinyl tube) can have an internal diameter of between about one quarter inch and about three eighths inch and an external diameter of between about three eighths inch and about one-half inch. Alternately, the flexible sleeve (52) and the grip (2) can be a single integral piece as shown in FIG. 9 formed about the resiliently flexible shaft (7) in a mold or by insertion of the resiliently flexible shaft (7) into the one piece flexible sleeve (52) and grip (2).

As can be easily understood from the foregoing, the basic concepts of the present invention may be embodied in a variety of ways. The invention involves numerous and varied embodiments of an inventive golf swing trainer and methods of using such embodiments of the inventive golf swing trainer.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "golf swing trainer" should be understood to encompass disclosure of the act of "golf swing training"—whether explicitly discussed or not—and, conversely, were there effectively disclosure of the act of "golf swing training", such a disclosure should be understood to encompass disclosure of an "golf swing trainer" and even a "means for golf swing training." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the golf swing training devices or systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A golf swing trainer, comprising:

a. a resiliently flexible shaft having a substantially non-elastic fixed length;

b. a swing element coupled to a first shaft end of said resiliently flexible shaft having radial symmetry about the longitudinal axis of said resiliently flexible shaft;

c. a grip coupled to a second shaft end of said resiliently flexible shaft, said grip having a lesser diameter end and a greater diameter end with diameter of said grip increasing with greater distance from said first end of said resiliently flexible shaft;

d. a grip end coupled to said greater diameter end of said grip, said grip end having a greater diameter than said greater diameter end of said grip; and e. a counter balance element coupled to said grip having an amount of mass which counter balances said resiliently flexible shaft, said grip end and said counter balance element provide a one piece grip end and counter balance element.

2. The golf swing trainer as described in claim 1, wherein said grip has a length along the longitudinal axis in a range of about 10 inches and about 20 inches.

3. The golf swing trainer as described in claim 2, wherein said lesser diameter end has a diameter of between about one-half inch and about one inch.

4. The golf swing trainer as described in claim 3, wherein said greater diameter end has a diameter of between about one inch and about one and one-quarter inch.

5. The golf swing trainer as described in claim 4, further comprising a plurality of rings each of said plurality of rings circumferentially engaged at intervals along said tapered external surface of said grip.

6. The golf swing trainer as described in claim 1, wherein said said grip end and said counter balance element have a combined weight of between about 200 grams and about 250 grams.

7. The golf swing trainer as described in claim 1, further comprising a flexible hollow cover which surrounds said resiliently flexible shaft between said grip and said swing element.

8. The golf swing trainer as described in claim 1, wherein said swing element has a weight of between about 225 grams and about 300 grams.

9. The golf swing trainer as described in claim 8, wherein said swing element has a spherical configuration with a diameter of between about three and one-half to about four and one-half inches.

10. A method of producing a golf swing trainer, comprising the steps of:

a. providing a resiliently flexible shaft having a substantially non-elastic fixed length;

b. coupling a swing element to a first shaft end of said resiliently flexible shaft, wherein said swing element has radial symmetry about the longitudinal axis of said resiliently flexible shaft;

c. coupling a grip to a second shaft end of said resiliently flexible shaft configured to gripably receive the hands, said grip having a tapered external surface disposed between a lesser diameter end and a greater diameter end with diameter of said grip increasing with greater distance from said first end of said resiliently flexible shaft;

d. coupling a grip end to said larger diameter end of said grip, wherein said grip end has a greater diameter than said greater diameter end of said grip; and e. coupling a counter balance element to said grip having an amount of mass which counter balances said resiliently flexible shaft, said grip end and said counter balance element provide a one piece grip end and counter balance element.

11. A method of producing a golf swing trainer as described in claim 10, wherein said grip has a length of said grip along the longitudinal axis of between about 10 inches and about 20 inches.

12. A method of producing a golf swing trainer as described in claim 11, further comprising the step of circumferentially engaging a plurality of rings each at intervals along said tapered external surface of said grip.

13. A method of producing a golf swing trainer as described in claim 10, further comprising the step of providing said grip end and said counter balance element with a combined weight in a range of about 200 grams and about 250 grams.

14. A method of producing a golf swing trainer as described in claim 10, further comprising the step of providing said swing element with a weight of about 225 grams to about 300 grams.

15. A method of producing a golf swing trainer as described in claim 14, further comprising the step of providing said swing element having a spherical configuration which has a diameter of between about three and one-half to about four and one-half inches.

16. A method of producing a golf swing trainer as described in claim 10, further comprising the step of surrounding said resiliently flexible shaft with a flexible hollow cover.

* * * * *